United States Patent [19]

Hooper

[11] 4,088,254

[45] May 9, 1978

[54] MAGNETIC HOLDING APPARATUS AND METHODS OF CONSTRUCTING AND UTILIZING SAME

[76] Inventor: Joel Ray Hooper, 2658 Tipsico Lake, Milford, Mich. 48042

[21] Appl. No.: 748,458

[22] Filed: Dec. 8, 1976

[51] Int. Cl.[2] ..... B65D 69/00

[52] U.S. Cl. ..... 224/45 R; 21/99; 21/105; 118/500; 211/41

[58] Field of Search ..... 224/45 R, 45 Q, 45 P; 294/65.5; 134/201; 99/415, 418; 259/DIG. 46; 211/41, DIG. 1; 118/500, 501; 21/99, 105

[56] References Cited

U.S. PATENT DOCUMENTS

| | | | |
|---|---|---|---|
| 2,648,127 | 8/1953 | Nelson | 211/DIG. 1 |
| 2,929,117 | 3/1960 | Kosswig | 21/105 X |
| 3,008,601 | 11/1961 | Cahne | 118/500 X |
| 3,868,016 | 2/1975 | Szpur et al. | 248/206 A X |
| 3,900,109 | 8/1975 | Peterson | 21/105 X |
| 3,998,333 | 12/1976 | Kamada | 211/41 |

FOREIGN PATENT DOCUMENTS

| | | | |
|---|---|---|---|
| 607,928 | 4/1926 | France | 99/415 |

*Primary Examiner*—Drayton E. Hoffman
*Assistant Examiner*—Donald W. Underwood
*Attorney, Agent, or Firm*—Irving M. Weiner; Pamela S. Austin

[57] ABSTRACT

A magnetic holding apparatus for holding magnetizable articles in a spaced apart relation. The apparatus employs a frame member including spaced apart support legs having permanent magnets mounted thereon to support the magnetizable articles. The apparatus is particularly adapted for holding magnetizable articles such as mason jar lids in a spaced apart relation when they are immersed in boiling water.

10 Claims, 3 Drawing Figures

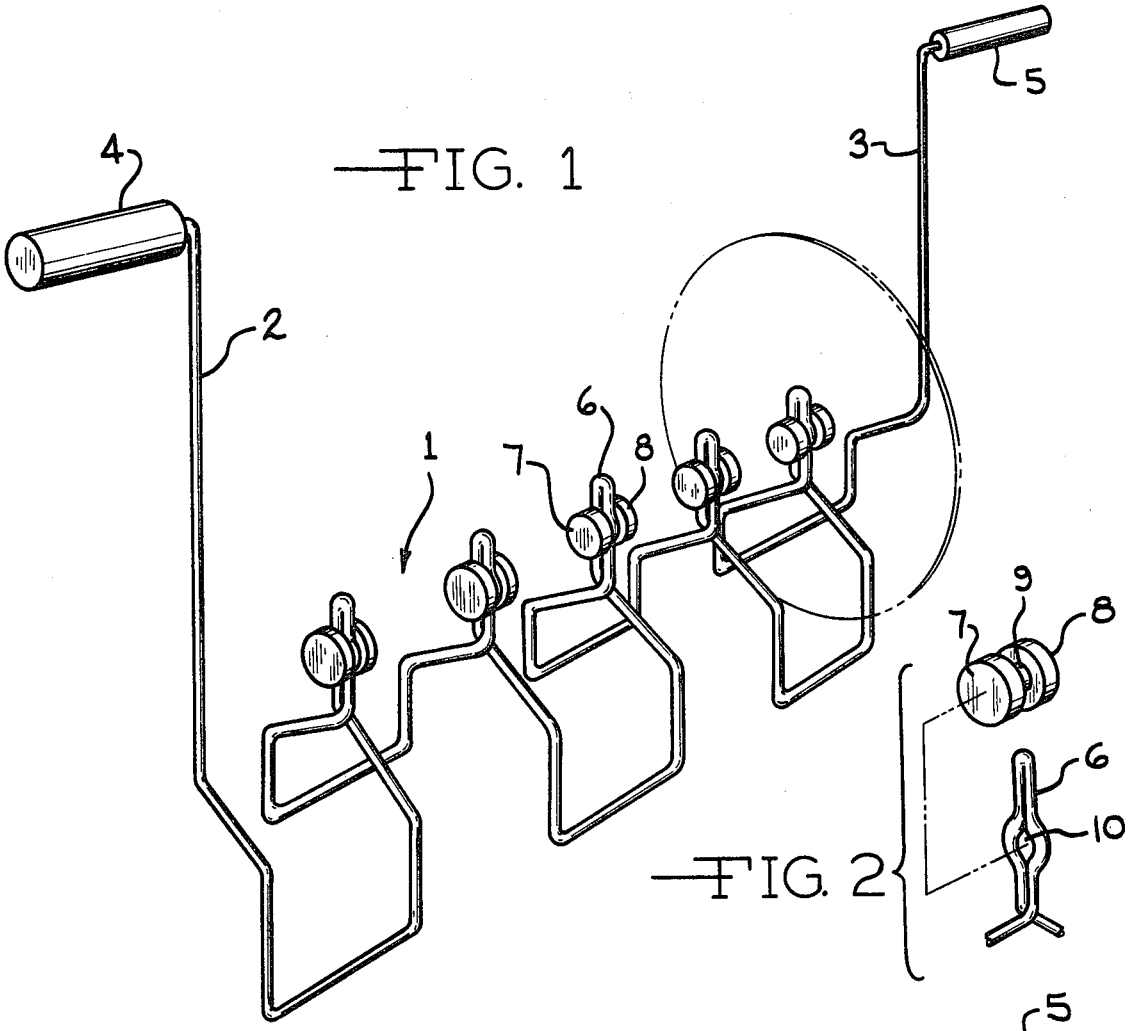
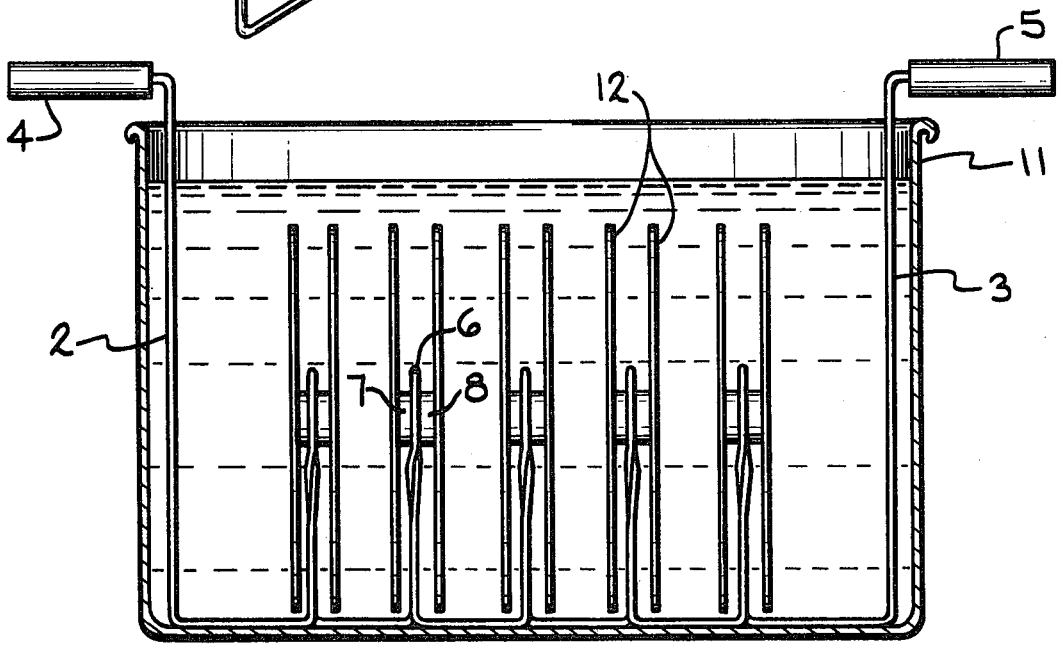
FIG. 3

MAGNETIC HOLDING APPARATUS AND METHODS OF CONSTRUCTING AND UTILIZING SAME

BACKGROUND OF THE INVENTION

1. Field of the Invention

The present invention relates generally to an apparatus for effectively holding a plurality of magnetizable articles in a spaced apart relation, and methods of constructing and utilizing same.

In particular, the invention relates to an apparatus which employs magnets to hold magnetizable articles, such as mason jar lids, in a spaced apart relation while the lids are being boiled in water.

2. Description of the Prior Art

One of the major disadvantages of home canning is the great deal of time consumption and hard work encountered by the homemaker. There have been many attempts made to minimize the time and effort required for the home canning operation, however, a major area of difficulty has remained. It is well known that in performing the required step of immersing mason jar canning lids in boiling water during the canning operation, the lids have a tendency to stick together in pairs or larger groups, thus resulting in time consumption and safety hazards in attempting to separate the lids for application to the mason jars. Heretofore, there have been no successful prior art attempts in solving this problem.

The present invention eliminates the foregoing problems by providing a magnetic holding apparatus which successfully and effectively retains the mason jar lids in a spaced apart relation during the boiling operation.

Illustrative of prior art attempts in the field of magnetic holding devices are: U.S. Pat. No. 2,803,595 issued in 1957 to Anzaldi entitled "ELECTROPOLISHING MAGNETIC ARTICLES", U.S. Pat. No. 2,966,992 issued in 1961 to Dunkelberger et al entitled "MAGNETIC HOLDER"; U.S. Pat. No. 3,017,036 issued in 1962 to Albert et al entitled "MAGNETIC SUPPORT"; U.S. Pat. No. 3,126,190 issued in 1964 to Miller entitled "MAGNETIC LICENSE BRACKET"; and U.S. Pat. No. 3,868,016 issued in 1975 to Szpur et al entitled "MAGNETIZED SURGICAL INSTRUMENT TRAY RESTRAINT."

The magnetic holding apparatus in accordance with the present invention eliminates the disadvantages and shortcomings attendant with the conventional prior art technique, and at the same time provides an apparatus which effectively minimizes the time and effort involved in home canning, with a minimum of parts and at an extremely reduced cost of manufacture.

SUMMARY OF THE INVENTION

The present invention provides an apparatus for holding magnetizable articles which includes a portable frame member having a plurality of spaced apart support legs. Each of the support legs has at least one permanent magnet mounted thereon so as to hold the magnetizable articles in a spaced apart relation. Each magnet is adapted to hold each article adjacent a predetermined portion of the article to permit a peripheral portion of the article to be grasped adjacent the peripheral portion for individual removal of each article from the apparatus.

In accordance with a preferred embodiment of the invention, there is provided an apparatus wherein the frame member is fabricated of rigid tubing with the support legs comprising spaced apart parallel loops formed in the tubing. The parallel loops are spaced apart a sufficient distance to permit mason jar lid covers to be held on the permanent magnets, and the magnets are mounted on the parallel loops so as to be parallel to each other. Preferably, each of the parallel loops has provided thereon a pair of spaced apart permanent magnets to permit each of the loops to support a pair of the lids in a spaced apart relation. The peripheral configuration of the frame member is adapted to conform in size and shape to the inside surface of a standard cooking pot, and the tubular frame member includes an extending arm portion at each end thereof which extends above the upper edge of the cooking pot. A handle is mounted at the upper end of each of the extending arm portions to facilitate transport of the apparatus to and from the cooking pot. The extending arm portions and the parallel loops of the frame member are disposed substantially perpendicular to the bottom edge of the cooking pot, and the entire apparatus is fabricated of substantially heat-resistant and liquid-resistant material to permit the apparatus to be immersed in boiling water without damage being incurred thereby.

The term "mason jar lid cover" as used herein is intended to connote the conventional metal circular lid portion employed with a flat rubber ring and a screw cap retainer to seal the wide-mouthed edge of a home-canning mason jar.

Other objects and details of the present invention will become apparent from the following description, when read in conjunction with the accompanying drawings.

BRIEF DESCRIPTION OF THE DRAWINGS

FIG. 1 illustrates a perspective view of a preferred embodiment of the apparatus in accordance with the present invention.

FIG. 2 depicts a sectional view of a support leg of the frame member for supporting the magnets.

FIG. 3 illustrates an elevational view of the apparatus in use, immersed in a pot of water with the mason jar lids positioned thereon.

DETAILED DESCRIPTION OF THE INVENTION

With reference to FIG. 1, the apparatus, including a main portable frame member 1, is illustrated. The frame member 1 comprises a tubing or wire member which is substantially rigid. For example, a wire equal in construction to a coat hangar wire may be employed. The frame member 1 is bent so as to form the two parallel extending arms 2 and 3. Each of the arms 2 and 3 is provided at the upper end thereof with a hooked portion to accommodate handles 4 and 5, respectively. The frame 1 is bent along its horizontal portion to form upwardly extending support legs 6. Although FIG. 1 depicts the frame 1 as including five of the legs 6, the apparatus can include any desired number of legs 6. It should be noted, however, that the distance between each of the legs 6 must be sufficient to permit the mason jar lids to be held thereagainst without contacting each other.

The upper ends of the legs 6 are looped as depicted in FIG. 2 to permit a magnet assembly including two small permanent magnets 7, 8 separated by a spacer 9 to be supported therethrough. The spacer 9 is snugly fitted within the aperture 10 of the loop and the magnets 7, 8 are positioned on either end thereof. If desired, however, the magnets 7, 8 can be replaced with an integral magnet (not shown), and the aperture 10 can be adapted to snugly accommodate the integral magnet. Indeed, any desired arrangement of either a pair of magnets or one integral magnet, which provides for extending magnet portions on either side of the aperture 10, can be employed.

As illustrated in FIG. 1, the legs 6 are arranged substantially parallel to one another and substantially parallel to the arms 2, 3. Further, the several pairs of magnets 7, 8 are mounted in a substantially parallel relationship to each other, with the longitudinal axis of the spacer 9 being substantially perpendicular to the legs 6 and arms 2, 3.

Referring now to FIG. 3, the apparatus as described hereinabove with respect to FIG. 1 is shown positioned for use in a standard cooking pot 11 which is substantially filled with water. The arms 2, 3 extend slightly above the upper edge of the cooking pot 11, thus positioning the handles 4, 5 above the cooking pot 11 for easy handling of the apparatus by the homemaker.

Each of the pairs of magnets 7, 8 have disposed thereon a metal mason jar lid 12 which is held firmly in position by the magnetic attraction provided by the magnets 7, 8. As can be seen, the lids 12 are held by the magnets 7, 8 in a position which is substantially perpendicular to the bottom surface of the cooking pot 11, with each of the lids 12 held substantially parallel to each of the other lids 12. The magnets 7, 8 themselves serve as spacing members to separate each of the pair of lids disposed on a particular leg 6, while the relative spacing of the legs 6 from one another serves to space each pair of lids 12 from each other pair. In this manner, each of the lids which is immersed in the water provided in the pot 11 is maintained in a separated spaced apart relation from each other lid 12, thus preventing the lids from contacting one another. The undesirable effect of the lids 12 sticking to one another during the water boiling operation is in this manner eliminated.

Upon removing the lids 12 from the boiling water, the homemaker has merely to lift the handles 4 and 5 to remove the desired number of lids, without having at any time to contact the boiling water to retrieve the lids therefrom. Because the lids are spaced apart, there is no need to attempt to separate the hot lids from each other, and thus a significant safety feature is also provided by the present invention.

It should be noted that the frame member 1 is adapted to conform in both size and shape to the interior of the cooking pot 11, thus preventing the apparatus from becoming unstable during the boiling operation, and also ensuring that the lids 12 maintain their desired spaced apart relationship throughout the boiling operation.

The present invention may be embodied in other specific forms without departing from the spirit or essential characteristics thereof. The present embodiments are therefore to be considered in all respects as illustrative, and not restrictive. The scope of the invention is indicated by the appended claims rather than by the foregoing description.

I claim:

1. An apparatus for holding magnetizable articles comprising:

a portable frame member;

said frame member including an upwardly extending arm portion disposed at each end thereof and an intermediate portion having a plurality of spaced apart support legs, each support leg extending upwardly from the intermediate portion and having a free extending end;

each of said support legs having at least one permanent magnet mounted proximal to the free extending end thereof so as to hold said magnetizable articles in a spaced apart relation;

each said magnet being adapted to hold each said article adjacent a predetermined portion of said article to permit a peripheral portion of said article to extend freely in a manner permitting each said article to be grasped adjacent said peripheral portion for individual removal of each said article from said apparatus; and said frame member being adapted to be placed in a fluid carrying pot with said arm portions extending upwardly from said pot and said intermediate portion with said support legs being disposed interiorly of said pot.

2. An apparatus in accordance with claim 1, wherein:

said portable frame member is fabricated of rigid tubing;

said support legs comprise spaced apart parallel loops formed in said tubing; and at least one handle is mounted on one of said arm portions to facilitate transporting said frame member.

3. An apparatus in accordance with claim 2, wherein:

each of said extending arm portions is provided with a handle; and said parallel loops are substantially parallel to said extending arm portions.

4. An apparatus in accordance with claim 2, wherein:

said magnets are mounted on said parallel loops so as to be parallel to each other; and said apparatus is fabricated of substantially heat-resistant and liquid-resistant material.

5. An apparatus in accordance with claim 2, wherein:

each of said parallel loops has provided thereon a plurality of spaced apart permanent magnets to permit each of said loops to support a plurality of magnetizable articles in a spaced apart relationship.

6. An apparatus in accordance with claim 3, wherein:

said handles are disposed substantially perpendicular to said extending arm portions; and said frame member is fabricated of an integral section of tubing with said tubing being bent to form said parallel loops.

7. An apparatus in accordance with claim 2, wherein:

said magnetizable articles comprise metal mason jar lids;

said magnets are mounted on said parallel loops so as to be parallel to each other; and said parallel loops are spaced apart a sufficient distance to permit said lids to be held on said permanent magnets in a spaced apart relation.

8. An apparatus in accordance with claim 7, wherein:

each of said parallel loops has provided thereon a pair of spaced apart permanent magnets to permit each of said loops to support a pair of said lids in a spaced apart relation.

9. An apparatus in accordance with claim 7, wherein:

said pot comprises a standard cooking pot;

the peripheral configuration of said frame member is adapted to conform in size and shape to the inside surface of said standard cooking pot; and a handle is mounted at the upper end of each of said extending arm portions.

10. An apparatus in accordance with claim 9, wherein:

said extending arm portions and said parallel loops of said frame member are disposed substantially perpendicular to the bottom edge of said cooking pot; and said apparatus is fabricated of substantially heat-resistant and liquid-resistant material to permit said apparatus to be immersed in boiling water.

* * * * *